US007088301B2

(12) United States Patent
Louzir et al.

(10) Patent No.: US 7,088,301 B2
(45) Date of Patent: Aug. 8, 2006

(54) SLOT TYPE PLANAR ANTENNAS

(75) Inventors: Ali Louzir, Rennes (FR); Philippe Minard, Saint Medard sur Ille (FR); Jean-François Pintos, Bourgbarre (FR)

(73) Assignee: Thomson Licensing, Boulogne-Billancourt (FR)

( * ) Notice: Subject to any disclaimer, the term of this patent is extended or adjusted under 35 U.S.C. 154(b) by 0 days.

(21) Appl. No.: 11/096,741

(22) Filed: Apr. 1, 2005

(65) Prior Publication Data

US 2005/0253765 A1 Nov. 17, 2005

(30) Foreign Application Priority Data

Apr. 6, 2004 (FR) ..... 04 50693

(51) Int. Cl.
*H01Q 13/10* (2006.01)

(52) U.S. Cl. ..... 343/767; 343/700 MS

(58) Field of Classification Search ..... 343/700 MS, 343/767–770

See application file for complete search history.

(56) References Cited

U.S. PATENT DOCUMENTS 5,872,542 A * 2/1999 Simons et al. ..... 343/700 MS
6,008,770 A * 12/1999 Sugawara ..... 343/767
6,259,407 B1 7/2001 Tran ..... 343/700 MS
6,337,662 B1 1/2002 Cassel ..... 343/702
6,483,462 B1 11/2002 Weinberger ..... 343/700 MS
6,982,671 B1 * 1/2006 Killen et al. ..... 343/700 MS
2004/0008146 A1 1/2004 Ikegaya et al. ..... 343/767

FOREIGN PATENT DOCUMENTS

FR 2 701 614 8/1994

OTHER PUBLICATIONS

Patent Abstract of Japan patent JP 11 284431, Oct. 15, 1999, Sumitomo Metal Ind. Ltd.
Copy of Search Report dated Nov. 30, 2004.

* cited by examiner

*Primary Examiner*—Hoang V. Nguyen
*Assistant Examiner*—Ephrem Alemu
(74) *Attorney, Agent, or Firm*—Joseph J. Laks; Robert D. Shedd; Brian J. Cromarty

(57) ABSTRACT

The present invention relates to a planar antenna comprising a resonating slot 12 dimensioned to operate at a given frequency, the slot being realized on a substrate 10 and supplied by a feed line 13 in a short circuit plane in which it is located. The substrate has a variable thickness 10*b*. The invention can be used in wireless networks.

9 Claims, 4 Drawing Sheets

(A) (B)

(a) Slot on "corrugated" substrate (b) Conventional slot

SLOT TYPE PLANAR ANTENNAS

This application claims the benefit, under 35 U.S.C. § 119 of French Patent Application 0450693, filed Apr. 6, 2004.

The present invention relates to a planar antenna, more particularly a slot type planar antenna presented in a compact form so as to be able to be integrated, for example, into terminals for wireless networks.

BACKGROUND OF THE INVENTION

The devices used in wireless networks are increasingly lightweight and small so as to respond to the requirements of users. Hence, the antennas designed for such terminals must have a reduced size while offering high performances.

However, although significant miniaturization is observed in the field of electronics, the laws of physics impose a minimum size for an antenna in order for it to function correctly in a given frequency band. Hence, for printed antennas, the dimensions are generally in the order of the wavelength at the central operating frequency.

Several techniques have been proposed for reducing the size of the antennas while retaining their radio-electric performances relating to yield, frequency bandwidth and radiation pattern.

Hence, in the French patent application no. 01 08235 filed on 22 Jun. 2001 in the name of THOMSON Licensing S.A., a description is made of an annular slot type planar antenna in which the slot has been shaped to extend the perimeter of this slot. This enables either the substrate dimensions to be reduced for a given frequency, or, at constant dimensions, to modify the operating frequency.

SUMMARY OF THE INVENTION

Knowing that the resonant frequency of a slot type antenna depends on the slot length, the present invention proposes a new technique for reducing the size of a slot type planar antenna that is independent from the shape of this slot.

Hence, the present invention relates to a planar antenna comprising a resonating slot dimensioned to operate at a given frequency, the slot being realized on a substrate and supplied by a feed line in a short-circuit plane in which it is located, the substrate presenting a variable thickness.

According to a first embodiment, the profile of the substrate face on which the slot is realised is a continuous profile, for example a sinusoidal profile.

According to another embodiment, the profile of the substrate face on which the slot is realised is a discontinuous profile, for example a crenelate profile, the crenelations can be square, rectangular, trapezoidal or presenting any other polygonal shape.

According to another characteristic of the present invention, the profile of the face of the substrate on which the slot is realized is a periodic or aperiodic profile. Hence, the period of the continuous or discontinuous profiles is constant or variable. For example, a substrate profile can present a low period on a first part of the length, then a longer period on another part of the length.

According to yet another embodiment, the profile of the substrate face on which the slot is realised is a radial symmetry profile. In this case, the slot can be an annular slot or a resonating slot-line.

The radial symmetry profile can also be associated with a continuous or discontinuous profile, as mentioned above.

According to another characteristic of the present invention, the feed line is preferentially located in a zone of constant substrate thickness.

BRIEF SUMMARY OF THE DRAWINGS

Other characteristics and advantages of the present invention will emerge upon reading the description of different embodiments, this description being made with reference to the drawings attached in the appendix, in which.

DESCRIPTION OF PREFERRED EMBODIMENTS

A description of a conventional linear resonating slot planar antenna will first be made with reference to FIG. 1.

Figure 1:
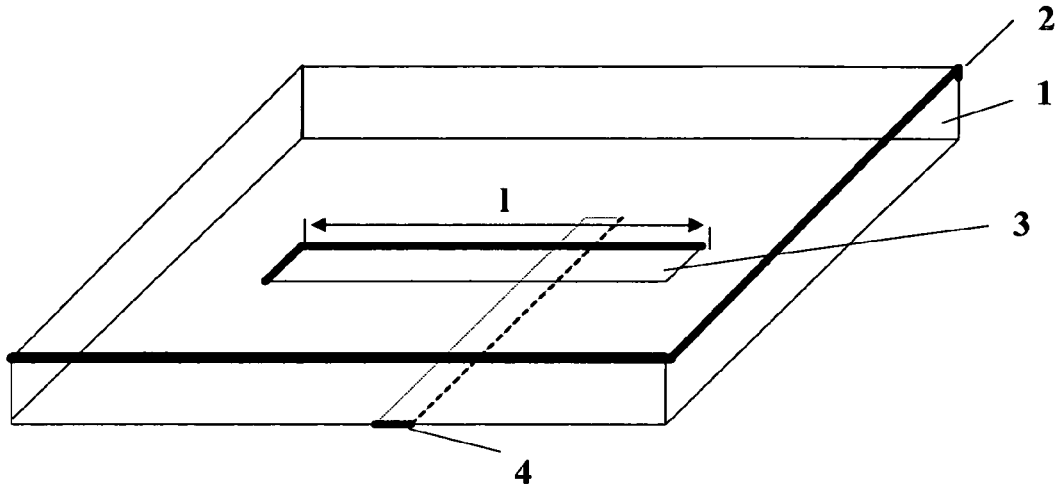
FIG. 1 is a diagrammatic perspective view of a linear slot type planar antenna, according to prior art.

As shown in FIG. 1, on a substrate 1 of a dielectric material covered by a ground plane 2 in a metal material, a linear slot 3 was etched. This slot has a length l which, in a known manner, is a function of the guided half-wavelength in the slot. More specifically, to operate at the resonant frequency of the fundamental mode, $l=\lambda s/2$, where $\lambda s$ is the guided wavelength in the slot.

Secondly, as shown in FIG. 1, on the face of the substrate 1 opposite the face featuring the slot 3, a feed line 4 is realized. This feed line 4 in a conductive material is positioned such that the slot is in a short circuit plane of the feed line, i.e. a wavelength $\lambda g/4$ of the feed line tip with $\lambda g$ the guided wavelength in the said feed line.

Hence, for a conventional planar antenna, the antenna dimensions at a given frequency are a function of the guided wavelength in the slot 3.

To reduce the total dimensions of the antenna, the present invention proposes to vary the thickness of the substrate supporting the slot type antenna. Thus, by modifying the vertical dimension of the substrate, it is possible to extend the length of the slot significantly and therefore to lower the resonant frequency or, which amounts to the same thing, for a given resonant frequency, reduce the substrate surface occupied by the printed antenna.

Figure 2:
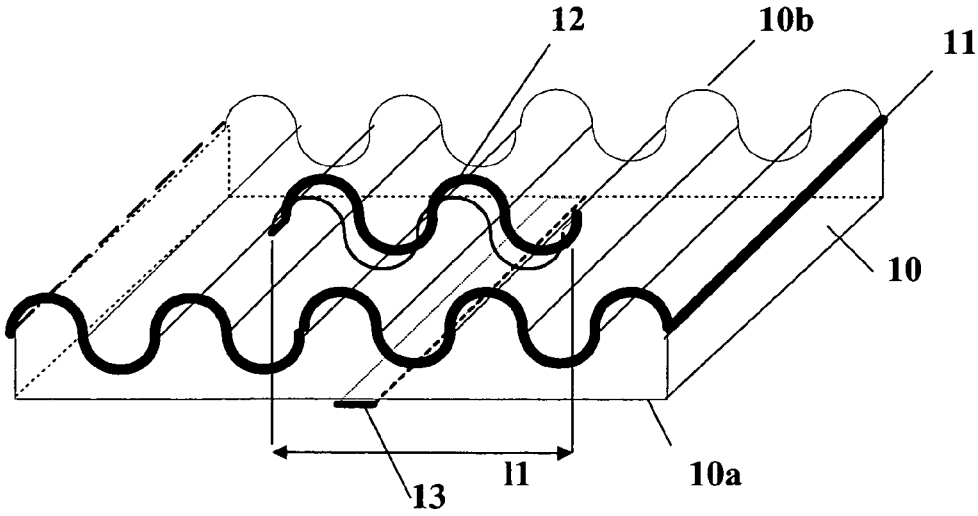
FIG. 2 is a diagrammatic perspective view of a linear slot type planar antenna, according to a first embodiment of the present invention.

In FIG. 2, a first embodiment of an antenna in accordance with the present invention is shown diagrammatically. Hence, the substrate 10 in dielectric material has a planar surface 10*a* on which a feed line 13 is realised in a conductive material whereas its opposite face, namely the face with the ground plane 11 and in which the linear slot 12 is etched, presents a continuous sinusoidal shape profile 10*b*. In this case, instead of a slot 12 of length l corresponding to a dimension l on the substrate, a dimension on the substrate equal to l1, where l1<l, is obtained for the same slot length. In this case, and as shown in FIG. 2, the feed line 13 is in a zone of constant substrate thickness and crosses the slot in a known manner in a short-circuit plane.

Indeed, it is preferable to position the feed line 13 in a zone of constant thickness, because the differences in thickness due to modifying the profile have an impact, mainly at the level of the normalized impedance of the resonating slot-line in the coupling zone with the feed line.

A practical embodiment of the present invention enabling the advantages of this invention to be highlighted will now be described with reference to FIGS. 3, 4, 5 and 6.

Figure 3:
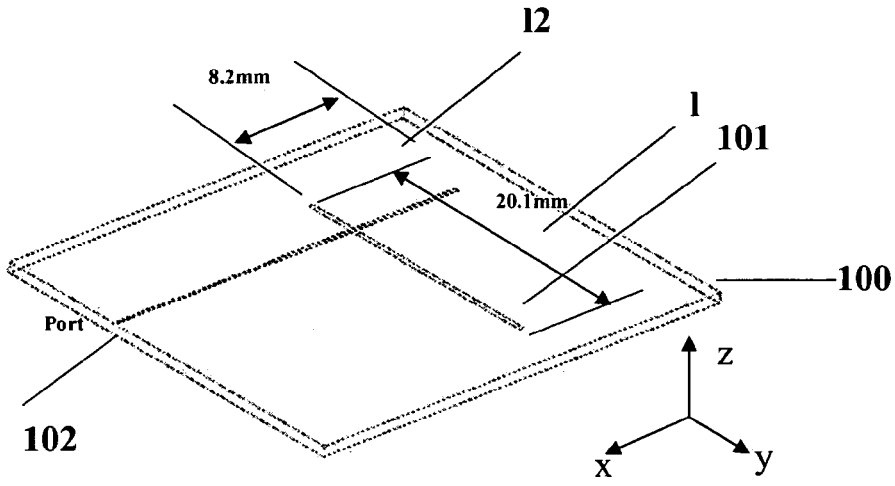
FIG. 3 is a diagrammatic perspective view of a linear slot type planar antenna, according to prior art.

Hence, in FIG. 3, a conventional resonant linear slot antenna of the type of the antenna of FIG. 1 is shown. This antenna is excited by electromagnetic coupling with a microstrip line 102 etched on the face of substrate 100 opposite the face receiving the slot 101. In the embodiment shown, the substrate in dielectric material has a permittivity of 3.38. The slot 101 etched on the substrate 100 has been dimensioned to operate at a central frequency of approximately 5.8 GHz. It has a length l equal to 20.1 mm and a width of 0.4 mm.

As shown in FIG. 3, the feed line 102 realised using microstrip technology crosses the slot 101 in such a manner that the end of the feed line 102, with respect to the slot, has a dimension 12 equal to 8.2 mm, which corresponds to $\lambda g/4$, where $\lambda g$ is the guided wavelength in the feed line.

In the FIGS. 4(A) and (B), a planar antenna is shown, comprising a linear resonating slot according to an embodiment of the present invention. This antenna was dimensioned to operate at the same frequency as the antenna of FIG. 3.

As shown clearly in FIGS. 4(A) and 4(B), the antenna in accordance with the present invention, was realized on a substrate 110 of permittivity 3.38. The surface 110*a* of the substrate on which the feed line 113 was realized using microstrip technology is planar whereas the surface 110*b* on which slot 112 is etched is a surface with a variable thickness. In this case, the profile of the surface 110*b* is a discontinuous profile of the crenelate type, each crenelation having a noticeably trapezoid shape. Hence, as shown more specifically in FIG. 4(A), the base of the crenelation has a dimension of 3 mm whereas its summit has a dimension of 1 mm.

Secondly, as shown in FIG. 4(B), the length l1, corresponding to 20.1 mm of the length of the slot, is only 9.1 mm. One can therefore note a significant reduction in the overall dimensions of the slot type planar antenna in accordance with the present invention.

Figure 4:
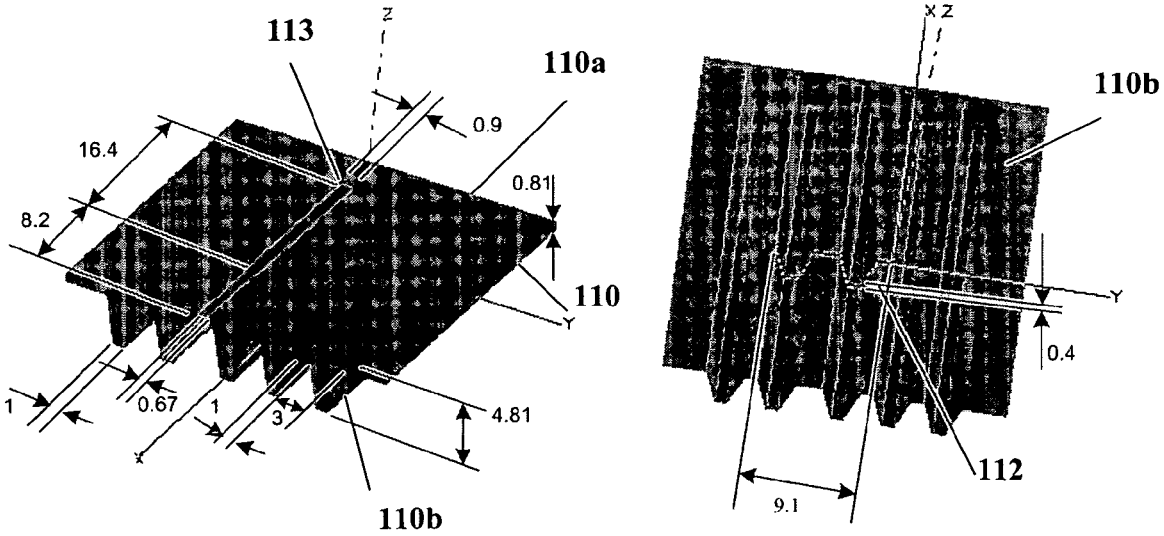
FIG. 4 shows respectively in bottom view (A) and top view (B) perspective, a linear slot type planar antenna, according to another embodiment of the present invention, this antenna being obtained by starting from the antenna shown in FIG. 3.
Figure 5:
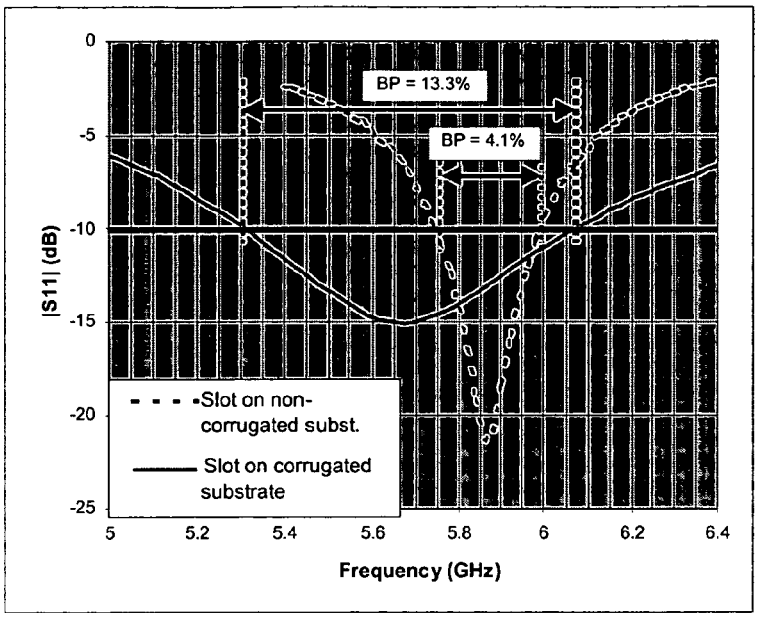
FIG. 5 shows the curves giving the adaptation S11 as a function of the frequency for the antenna shown in FIG. 3 and for the antenna shown in FIG. 4.
Figure 6:
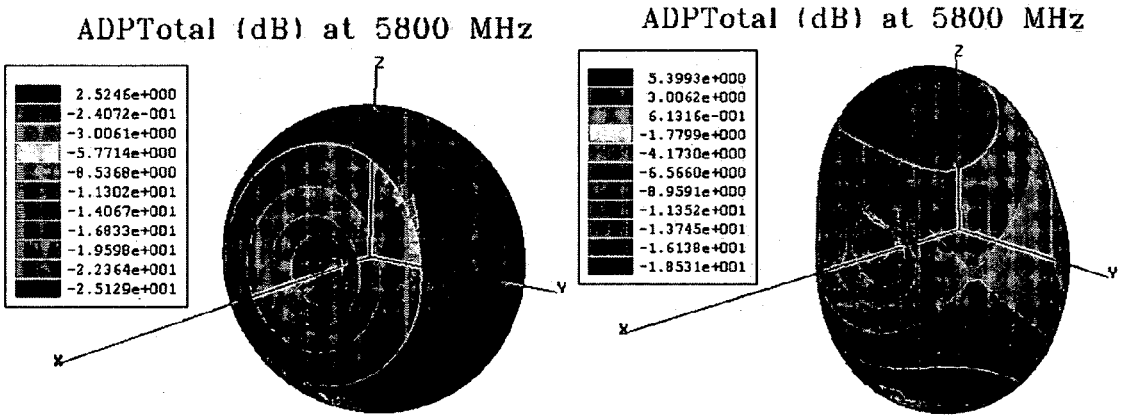
FIG. 6*a* shows the radiation pattern of the antenna of FIG. 4 and, FIG. 6*b* shows the radiation pattern of the antenna of FIG. 3.

To highlight the advantages of this type of antenna, the comparative results of a simulation between the antenna of FIG. 3 and the antenna of FIG. 4 are given in FIGS. 5 and 6.

FIG. 5 shows the adaptation curve as a function of the frequency of the two antennas. The dotted curve relates to the antenna of FIG. 3 while the solid line curve relates to the antenna of FIG. 4. Comparing both curves shows that the two antennas radiate noticeably at the same frequency, namely 5.6 GHz for the antenna in accordance with the invention and 5.80 GHz for the reference antenna. The resonant frequency of the antenna in accordance with the invention is lower than approximately 200 MHz. On the other hand, a significant widening of the frequency bandwidth is observed, passing from 4.1% for the reference antenna to 13.3% for the antenna in accordance with the invention.

Finally, comparing the radiation patterns of the antenna according to the invention shown in FIG. 6(A) and the reference antenna shown in FIG. 6(B) shows that the antenna according to the invention benefits from a more omnidirectional radiation pattern. This comes from the fact that the oblique slot segments do not radiate perpendicularly to the substrate but laterally to the substrate.

Figure 7:
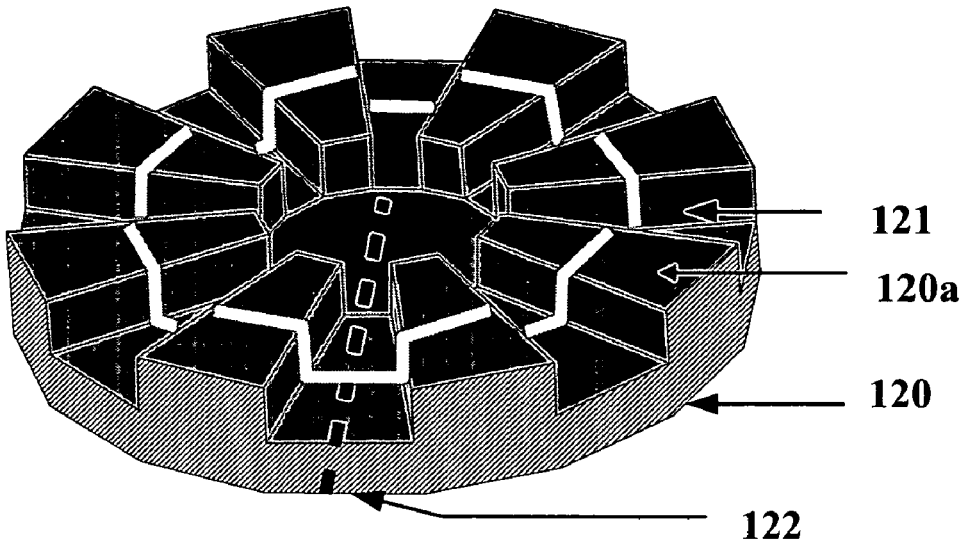
FIG. 7 and FIG. 8 are respectively diagrammatic perspective views of other embodiments of the substrate for a planar antenna in accordance with the present invention, respectively for an annular slot type antenna and for a linear slot type antenna.
Figure 8:
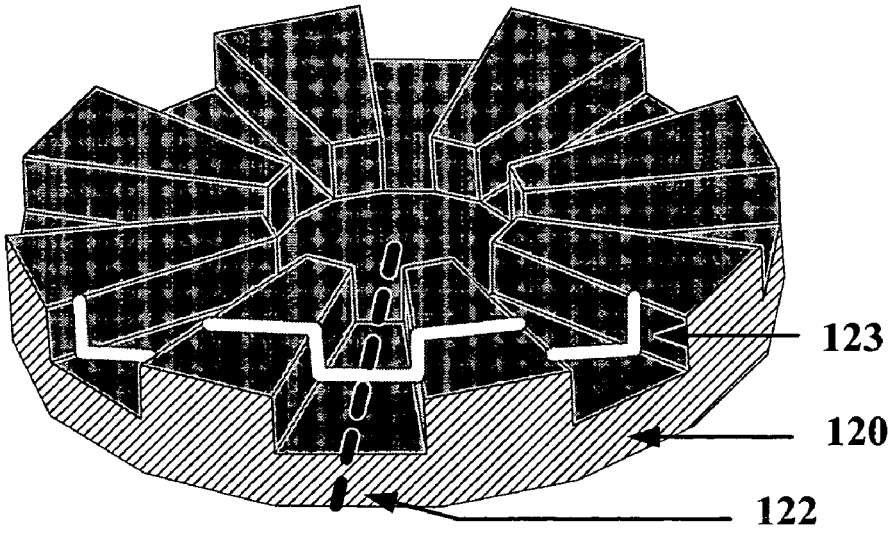

We will now describe with reference to FIGS. 7 and 8, different variants of embodiments of the present invention. In both embodiments, the substrate 120 is noticeably cylindrical in form. The lower face of the substrate 20 is planar and features a feed line 122 realized using microstrip technology according to a radial direction. The upper face 120*a* on which the slot is etched presents a discontinuous profile, more particularly a crenelate profile. FIG. 7 shows the case of an annular slot 121 while FIG. 8 shows the case of a resonant linear slot. In both cases, the size of the substrate is reduced for operation at a given frequency.

Generally, the materials used to realize this type of variable thickness substrate are, for example, materials of the foam type, plastic type or any other dielectric material enabling the realization of variable height substrates.

According to the volume of the parts required, the profile can be obtained by machining, moulding, stereolithography or any other method enabling the realization of variable height substrates, It is evident to those in the profession that the embodiments described above can be modified without falling outside the scope of the claims.

What is claimed is:

1. A planar antenna comprising a resonating slot dimensioned to operate at a given frequency, the slot being realized by etching a ground plane of a substrate and supplied by a feed line positioned in a short-circuit plane in which it is located, wherein the face of the substrate receiving the slot presents a variable thickness.

2. Antenna according to claim 1, wherein the face of the substrate on which the slot is realized has a continuous profile such as a sinusoidal profile.

3. Antenna according to claim 1, wherein the face of the substrate on which the slot is realized has a discontinuous profile such as a crenelate profile.

4. Antenna according to claim 2, wherein the profile of the face of the substrate on which the slot is realized is a periodic or aperiodic profile.

5. Antenna according to claim 3, wherein the profile of the face of the substrate on which the slot is realized is a periodic or aperiodic profile.

6. Antenna according to claim 1, wherein the face of the substrate on which the slot is realized has a profile with a radial symmetry profile.

7. Antenna according to claim 6, wherein the variable symmetry profile is associated with a continuous profile such as a sinusoidal profile.

8. Antenna according to claim 6, wherein the variable symmetry is associated with a discontinuous profile such as a crenelate profile.

9. Antenna according to claim 1, wherein the feed line is located in a zone of constant substrate thickness.

* * * * *